US006041505A

United States Patent [19]

Chen

[11] Patent Number: 6,041,505

[45] Date of Patent: Mar. 28, 2000

[54] ILLUMINATING KNIFE DEVICE

[76] Inventor: Kun Chen Chen, No. 6, Lane 609, Sec. 1, Chung Shan Road, Tachia Chen, Taichung Hsien, Taiwan

[21] Appl. No.: 09/249,084

[22] Filed: Feb. 12, 1999

[51] Int. Cl.[7] ..... B26B 1/08; B26B 1/10

[52] U.S. Cl. ..... 30/123; 30/162; 362/120

[58] Field of Search ..... 30/123, 125, 162, 30/335; 7/158, 160; 362/120, 119

[56] References Cited

U.S. PATENT DOCUMENTS 4,669,186 6/1987 Liu ..... 30/125

5,023,761 6/1991 De Lang ..... 362/120

5,315,760 5/1994 Emerson ..... 7/160 X

*Primary Examiner*—Douglas D. Watts

*Attorney, Agent, or Firm*—Bacon & Thomas, PLLC

[57] ABSTRACT

An illuminating knife device with two outer housings joined together to form an opening and a lighting hole at one end to construct a knife kit. A control mechanism associated with a blade is positioned inside the knife kit and is selectively movable to extend the blade out of the outer housings or to retract the blade back into the interior of the outer housing via the opening. A lighting device is installed in the other outer housings next to the opening for the blade, that can emit light to a desired range.

3 Claims, 4 Drawing Sheets

ILLUMINATING KNIFE DEVICE

BACKGROUND OF THE INVENTION

1. Field of the Invention

This invention primarily relates to a knife device that can illuminate and act as an aid for knife cutting.

2. Description of the Prior Art

Generally a retractable knife used for cutting has its blades hidden inside a handheld housing so that a blade can be pulled out or retracted by hand manipulation. When the cutting application under a dim to dark situation is desired, an extra lighting source must be provided and powered to provide the required illumination which may be inconvenient to the users.

SUMMARY OF THE INVENTION

An illuminating knife device includes: two outer housings that can be joined together as an integral grip; a control mechanism is hidden inside the housing and can activate push-out or pull-back movement positions; a lighting device, etc. Along with these components, a control mechanism is equipped with a replaceable blade and as well as a lighting device.

The goal of this invention is to provide a knife structure that can provide lighting to allow knife cutting under dim to dark situations.

DETAILED DESCRIPTION OF THE PREFERRED EMBODIMENT

Figure 1:
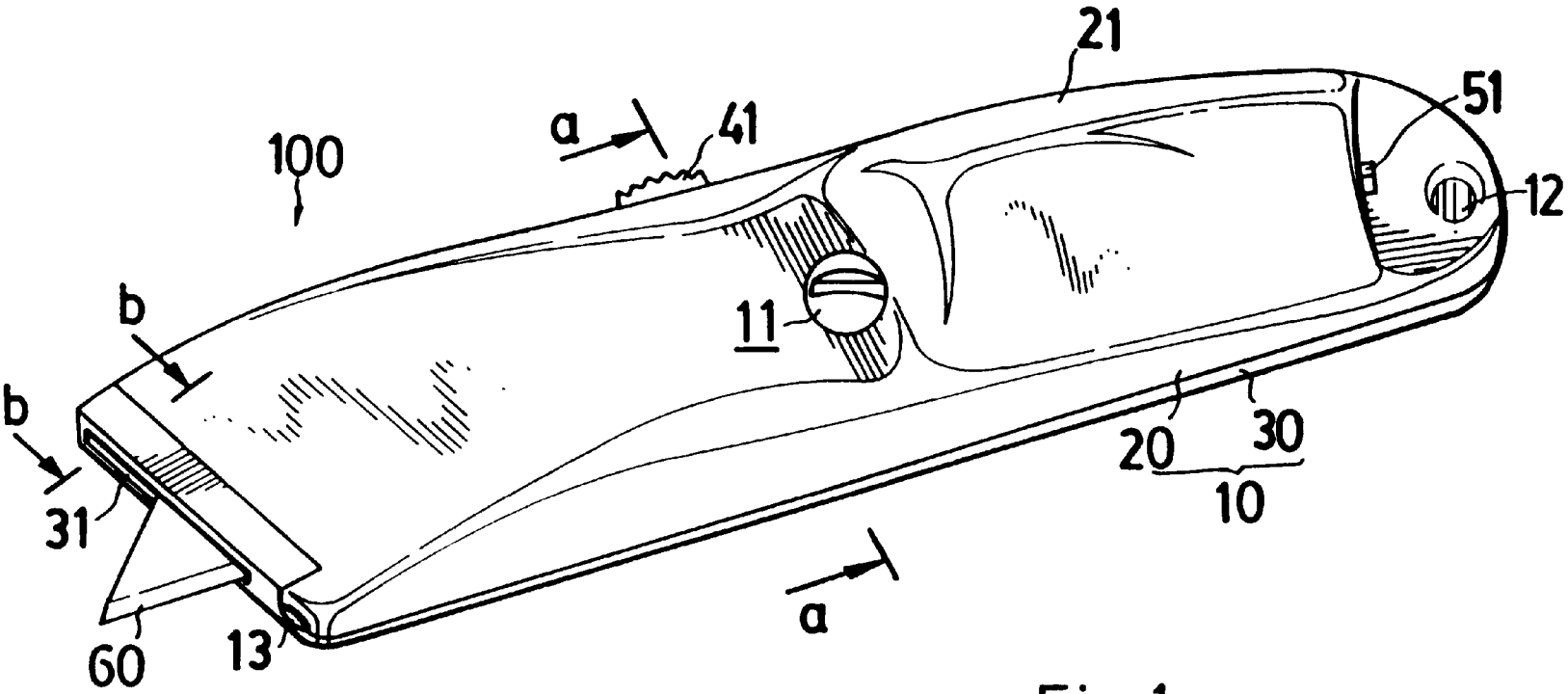
FIG. 1 is a schematic elevational view of the knife after final assembly.

As shown in FIG. 1, two outer housings 20,30 are joined together to form a knife kit 10 and are secured by using a thread-joint element 11 (bolts, screws or other fasteners); a hole 12 is provided for attachment to a hook and a switch 51 is recessed at one end while an opening 31 and a lighting hole 13 are positioned at the other end. A blade 60 is hidden inside the knife kit 10. These elements are all incorporated to construct an illuminating knife 100. The blade 60 will be stretched out from the opening 31 for cutting purposes or it will be retracted into the interior of the knife kit 10 via the push button 41. The electrical power source switch 51 can be energized directly to power the light 13 and to point light at a cutting location under dark conditions.

The outer housing 20 has been shaped outwardly to form a specially protruded grip 21. The grip 21 is ergonomically designed for a more comfortable fit for the user of the flat knife kit 10 to do a cutting operation.

Figure 2:
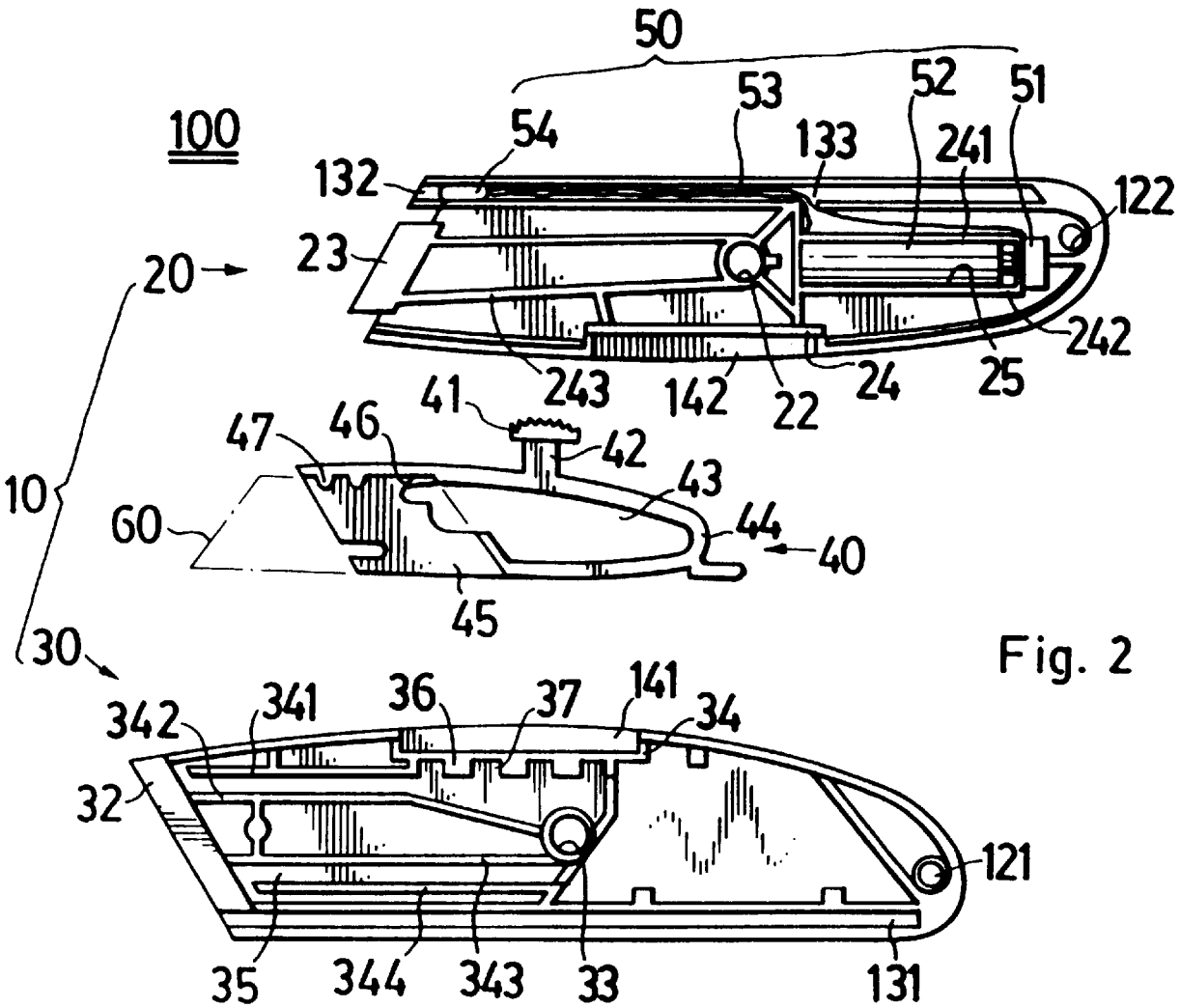
FIG. 2 is a planar exploded view of the knife after the two outer housings and the control mechanism have been disassembled.

Referring to FIG. 2, the knife kit 10 is constructed by two outer housings 20,30 that contain a control mechanism inside, with an assembly type blade 60 (demonstrated in dotted lines). The press-fit rod 44 is designed with a hollow hole 43 by using integrated-molding technology; it can be linked to push button 41 via the neck 42 of the positioning block 48 that is projected at its upper portion (see FIG. 3). The plane 45 is indented at the side edge corresponding to the position of the blade 60 and has a depth equal to or slightly larger than the thickness of the blade 60. An adjoining wall 46 includes an adapter 47 which is positioned between plane 45 and press-fit rod 44.

Figure 5:
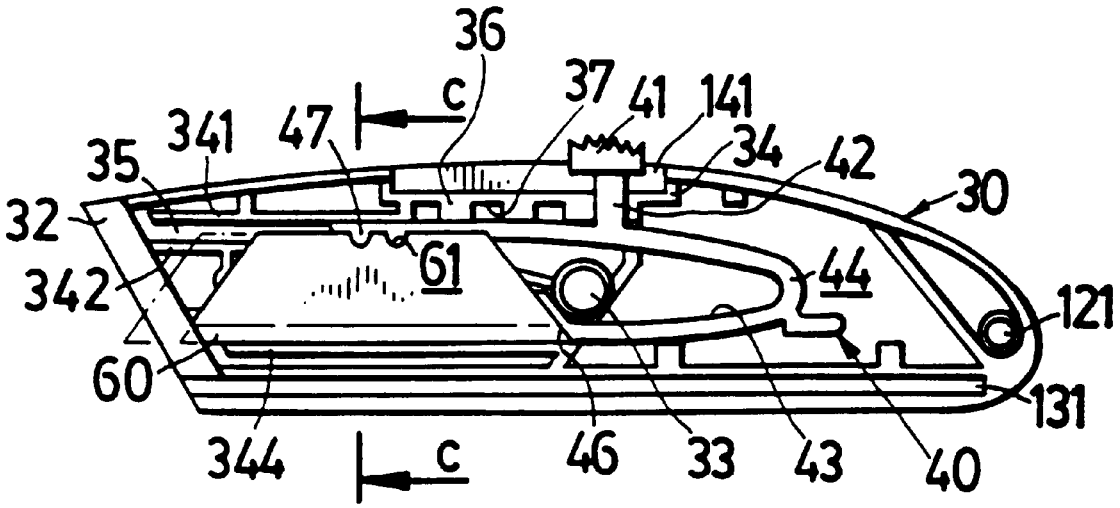
FIG. 5 is a planar drawing showing the control mechanism installed at the outer housing with the blade retracted wherein the dotted lines represent the stretched out blade movement actuated by the control mechanism and linked to the blade.

In FIG. 5, the blade 60 is placed next to plane 45 and a conformably concave groove 61 matching blade's shape is positioned at the side opposite to the adapter 47 to restrain the blade 60, and to move in the same direction with the control mechanism.

Figure 6:
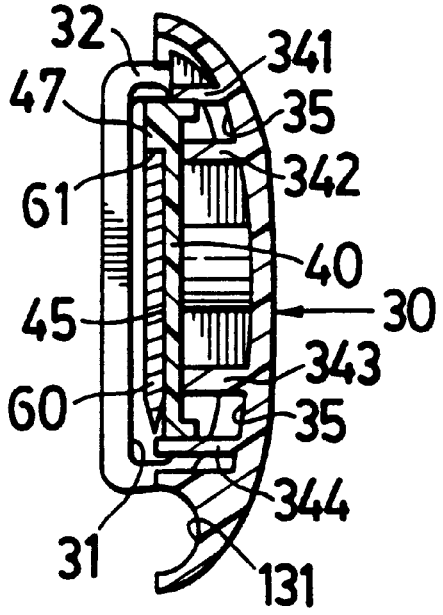
FIG. 6 is an enlarged cross-sectional view taken along line c—c of FIG. 5, showing the coupling relation between the outer housings and the control mechanism.

The other outer housing 30 (as shown in FIGS. 2, 5 and 6) has been machined to form an opening 31 and the coupler 32 at one end while a thread hole 33 is tapped in the middle portion and a circular hole 121 is drilled at the other end. There are several ribs 34 transversely inlaid from the thread hole 33 to the coupler 32 for reinforcement purposes. Meanwhile, the ribs 341, 342, 343, 344 have been machined and a guide slot 35 is formed having a width equal the press-fit rod 44 and a depth larger than the press-fit rod's thickness. A semi-open space 141 is formed by longitudinally recessing the ribs 34 across its length and above the thread hole 33. There are stops 36 shaped like a continuous square tooth and provided below ribs 34, wherein two stops 36 will form a fit 37. A semi-close lighting slot 131 is provided transversely across the length of the device and below the coupler 32.

The control mechanism 40 is placed horizontally on the outer housing 30 with blade 60 positioned as previously mentioned and the thread hole 33 is aligned with hollow hole 43. The periphery of the press-fit rod 44 is inserted into the two guide slots 35, ribs 341,344 that are set as the upper and lower boundary limits for the blade, another two ribs 342, 343 will contact the surface of the plane 45 without the blade 60. At this point, the positioning block 48 of the neck 42 is located at the control mechanism 40 (see FIG. 3).

Figure 3:
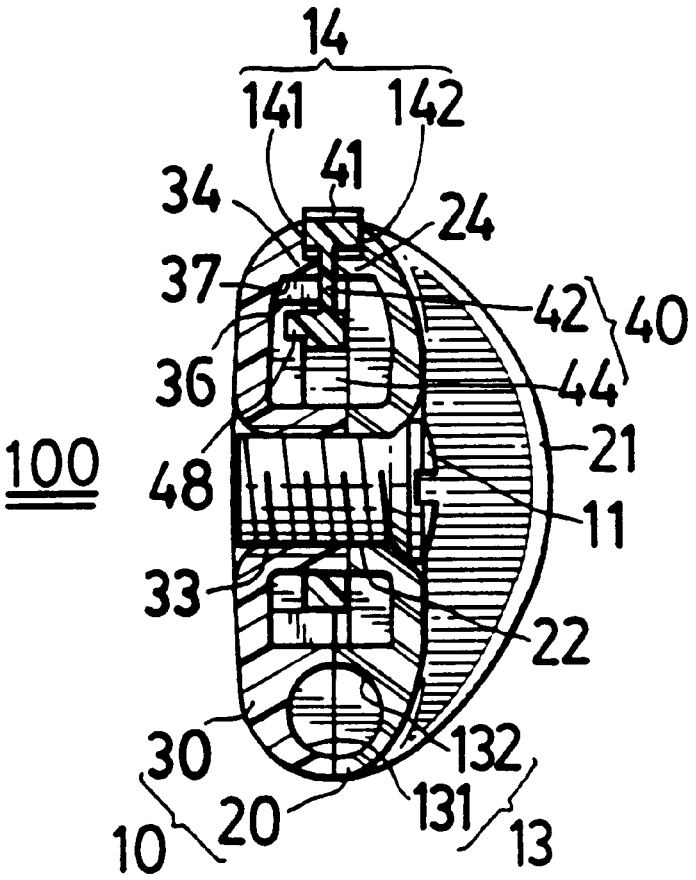
FIG. 3 is an enlarged cross-sectional view taken along line a—a of FIG. 1, showing how the coupling relationship between the two outer housings and the control mechanism.
Figure 4:
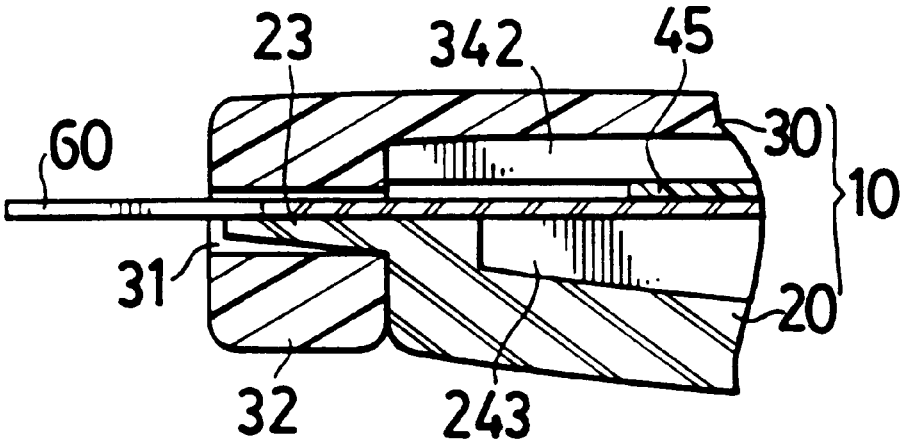
FIG. 4 is an enlarged cross-sectional view at one end of the joined housings, taken along line b—b of FIG. 1, showing the connecting relation when the blade is being stretched out by the control mechanism and the two outer housings are joined together.

As shown on FIGS. 2–4, one end of the outer housing 20 has been shaped as an expanded arc grip 21 with a drilled circular hole 122 while a hole 22 is drilled in the middle portion and a split part 23 is positioned at the other end, and reinforced by several ribs 24. The perforated hole 22 is regarded as a base point and a lighting slot 132 with semi-close notch 133 is shown on the upper part of the FIG. 2, the semi-open space 142 is shown on the lower part of the FIG. 2, an electrical power source compartment 25 is constructed by two ribs 241,242 (interior part of grip 21), and there are additional ribs 243 shown in FIG. 2.

A lighting device 50 including a switch 51 is installed adjacent to the electrical power source compartment 25, where the external portion of the switch is projected outside of the outer housing 20. A battery cell 52 is secured in the battery holder 25, and a lighting bulb 54 is secured near one end of the split part 23, near the lighting slot 132 and connected with electrical wire 53 (or circuit).

As illustrated in FIGS. 3–5, the split part 23 of the outer housing 20 is inserted into the opening 31 of the coupler 32 at the outer housing 30. Then the two outer housings 20,30 are united to form a knife kit 10 by using the thread element 11 to screw through the perforated hole 22 and into the thread hole 33. The semi-open spaces 141,142 are individually located at the outer housings 20,30 and are joined to form a press-in slot 14 to secure the push button 41. There are interval gaps established between the ribs 24,34 where only the neck 42 can pass through. Furthermore, the press-fit rod 44 and the two side faces of the plane 45 where the blade 60 is loaded, is contacted by ribs 342,243 or split part 23, and the opening 31 that can function as a guide for the blade 60. The lighting slots 131,132 together form a lighting hole 13 with a circular or elliptical cross-section.

The knife device 100 assembled according to the above discussed configuration can be used by pressing down the push button 41 to actuate the movement of the drive neck 42 together with the press-fit rod 44 downward. Meanwhile, the positioning block 48 can be released from the restriction range between stops 36 and fit 37, and moved downward with the neck 42. In so doing, the control mechanism 40 can be driven, causing the blade 60 to extend out into the guide slot 35 as shown in dotted line in FIG. 5. After the appropriate length is determined then the force on push button 41 is released, and then press-fit rod 44 will return to its original position and rebound upward along with the neck 42 and the push button 41 due to the elasticity of the materials. At the same time, the positioning block 48 will match the fit 37 to complete the matching action. Then the forward and backward directions are restricted by the stop 36 so that the user can manipulate the cutting operation of the blade 60.

The user can obviously reverse the above step to retract the extended blade 60 and confine it inside the knife kit 10. Regardless of where the components (such as the thread hole 33, perforated hole 22, hollow hole 43 or the battery cell 52 contained in the electrical power source compartment 25 or electrical wire 53 wired to lighting bulb 54 via notch 133 etc), are configured this will not affect the stretch-out or retraction of movement of the control mechanism 40.

In darkness, the lighting device can be turned on to emit light. Since the lighting hole is located underneath the blade, the light emitting source will sufficiently extend light to aid in the cutting. The switch can be easily activated and the safety hazard to the user due to use in dim light is eliminated.

I claim:

1. An illuminating knife device, comprising a knife kit comprising at least two outer housings that are joined to form at one end an opening and a lighting hole, a press-in slot formed between the housings and recessed toward a split part, one of the outer housings having a plurality of tooth-shaped stops and configured below the press-in slot such that a fit can be formed between two of the stops that are adjacent and a guide slot leading toward the opening, the knife kit containing an electrical power source compartment adapted to contain one or more battery cells and a lighting slot extending to the lighting hole;

a blade;

a partially elastic control mechanism with one end joined to the blade and another end connected to a push button, the push button configured to actuate a reciprocating movement of the control mechanism at the press-in slot, said control mechanism substantially configured within the knife kit;

a neck connected to the push button and configured to transmit reciprocating movement within the interval gaps of the press-in slot;

a plurality of positioning blocks positioned below the neck, the stops adapted to the neck to move along with the neck when the push button is pressed and moved to selectively match one of the stops such that the blade can be extended out of the opening or retracted back into a secured position inside the knife kit; and a lighting device comprising a light bulb secured inside the lighting slot, a wire/circuit connected between the light bulb and the electrical power source compartment, and a switch extending out from one of the housings and adapted for manipulation by a user, said light bulb when powered capable of transmitting light to an effective range.

2. An illuminating knife device as claimed in claim 1, wherein the two outer housings include a machined and threaded bore, the two outer housings joined by a thread element inserted into the machined and threaded bore to enclose the knife kit, and the outer housings including internal ribs;

said one of the outer housings including the stops configured with two parallel ribs leading from the location of the control mechanism to the opening to form a guide slot;

an end of the control mechanism being hollow and peripherally configured with an elastic press-fit rod while the other end is recessed in a concave plane; the press-fit rod connected to the push button via the neck and with the positioning blocks; a wall with an adapter at an adjoining plane where the plane and the press-fit rod can be joined to the recessed groove on the edge of the blade that is flatly placed; and one of the outer housings shaped outwardly to form an expanded arc-like grip that is ergonomically configured for comfortable manipulation by a user.

3. An illuminating knife device as claimed in claim 1 wherein one of the outer housings has a central opening with a coupler and the other outer housing has an adapter configured for insertion into the central opening.

* * * * *